US010029833B2

(12) United States Patent
Zhang

(10) Patent No.: US 10,029,833 B2
(45) Date of Patent: Jul. 24, 2018

(54) QUICKLY-SEALING COVER

(71) Applicant: NINGBO EASY HOUSEWARE CO., LTD., Ningbo, Zhengjiang Province (CN)

(72) Inventor: Yabin Zhang, Ningbo (CN)

(73) Assignee: NINGBO EASY HOUSEWARE CO., LTD., Ningbo, Zhengjiang Province (CN)

( * ) Notice: Subject to any disclaimer, the term of this patent is extended or adjusted under 35 U.S.C. 154(b) by 12 days.

(21) Appl. No.: 15/153,435

(22) Filed: May 12, 2016

(65) Prior Publication Data

US 2017/0129667 A1 May 11, 2017

(30) Foreign Application Priority Data

Nov. 5, 2015 (CN) ..... 2015 2 0875008 U

(51) Int. Cl.
*B65D 25/28* (2006.01)
*B65D 53/02* (2006.01)
*B65D 23/10* (2006.01)

(52) U.S. Cl.
CPC ..... *B65D 53/02* (2013.01); *B65D 23/10* (2013.01); *B65D 25/28* (2013.01); *B65D 2525/283* (2013.01)

(58) Field of Classification Search
CPC ..... B65D 53/02; B65D 23/10; B65D 25/28; B65D 2525/00–2525/283; B65D 43/26; B65D 43/262; B65D 51/00
USPC ..... 220/212, 212.5, 317, 318, 846, 262
See application file for complete search history.

(56) References Cited

U.S. PATENT DOCUMENTS 5,799,909 A * 9/1998 Ziegler ..... B65F 1/1415 220/481
8,333,293 B2 * 12/2012 Morand ..... B65F 1/062 220/263
8,418,869 B2 * 4/2013 Yang ..... B65F 1/06 220/264
2014/0183193 A1 * 7/2014 Hammond ..... B65F 1/002 220/87.2

FOREIGN PATENT DOCUMENTS

CN 204600048 U 9/2015

* cited by examiner

*Primary Examiner* — Kareen Thomas
(74) *Attorney, Agent, or Firm* — Muncy, Geissler, Olds & Lowe, P.C.

(57) ABSTRACT

A quickly-sealing cover having a cover body matched with a cup body or bottle body, in which the lower end of cover body is partially embedded. The outer wall at the lower end is equipped with an inward-retracted bevel edge, forming a wedge-shaped opening surrounding the lower end. Below the cover body a push pedal is flexibly installed on which a sealing ring is equipped. The upper edge of the sealing ring is opposite the wedge-shaped opening. The upper edge of the sealing ring is embedded into the wedge-shaped opening when the push pedal moves upward. This achieves a perfect sealing effect between cover body and cup body or bottle body. The cover is firmly attached to the mouth edge of cup body or bottle body due to static friction force increased, without screw connection, thus the mouth edge may be in any form in addition to circle.

9 Claims, 3 Drawing Sheets

QUICKLY-SEALING COVER

TECHNICAL FIELD

The utility model relates to a cover attached to cup or bottle, more specifically, a cover capable of sealing the mouth edge of cup or bottle.

BACKGROUND

The cup or bottle that is currently used has a cover that is of threaded connection, and a seal ring is always embedded into the internal thread of the cover to improve airtightness of the cover, but the friction is caused between the mouth edge of cup or bottle and the seal ring when turning the cover, grinding out of the seal ring slight rubber mass, which is dropped into the cup or bottle and harmful to human body. This type of cover is only suitable for the cup or bottle with round mouths and cannot be used for those with polygon or irregularly shaped mouths. The gland-type vacuum cup with patent No. 201520148280.0 that was disclosed by Patent Office of the People's Republic of China in Sep. 2, 2015 has a cup-attached steel wire piece installed within the upper ring groove, on its one end hangs a gland steel wire piece that is freely moveable and mounted on the gland, on its another end installs a moving piece, the manual upward/downward movement of which may compress gland or make it leave from seal, and replace the mode of compressing the seal ring by hand tightening the cup cover. The disadvantage of the vacuum cup lies in the outside exposed steal wire piece and moving piece that undermine aesthetic appearance, cause inconvenience to store and carry with, and are vulnerable to external forces and unable to compress gland when distorted.

SUMMARY

This utility mode aims to overcome defects and shortcomings of existing technology by providing a quickly-sealing cover with good sealing effect at the mouth edge of cup or bottle.

The technical solution adopted in this invention for abovementioned purpose is that the quickly-sealing cover comprises cover body matched with cup body or bottle body, with the lower end of cover body partially embedded into cup body or bottle body, the outer wall at the lower end of cover body is equipped with an inward-retracted bevel edge, forming a wedge-shaped opening that surrounds the lower end of cover body between the lower end of cover body and cup body or bottle body, below the cover body flexibly installs a push pedal, on which sealing ring is equipped, the upper edge of sealing ring is opposite to the wedge-shaped opening; and the upper edge of sealing ring is embedded into the wedge-shaped opening when the push pedal moves upward.

The push pedal is partially inserted into the bottom part of cover body.

The push pedal is equipped with an upward extended shaft, a lifting element that is equipped within the cover body is set to the shaft, on which a guide block that is flexibly embedded into a spiral guide groove that is placed on the outer wall of the lifting element is equipped; when the lifting element rotates, the guide block may move in the spiral guide groove, driving the push pedal to move upward and downward.

The fore shaft is equipped on the upper end of the spiral guide groove.

The bearing spring is placed between the push pedal and cover body.

Two spiral guide grooves (1.3) that are centrally symmetric are provided on the lifting element, and two guide blocks are accordingly provided on the shaft.

A handle installed on the upper end of the lifting element is capable of rotating the lifting element when turning it.

The handle that is hinged with the lifting element is capable of being folded and embedded into a groove that is provided on the cover body.

The square-shaped locked groove is provided on the upper part of the installing groove that is provided at both sides of the lifting element, an installing block that is capable of being embedded into the square-shaped locked groove is provided on the handle, and the top surface and both sides of the installing block are planes, making the handle locked at the vertical-open status and the horizontal-folded status.

This utility model installed on cup body or bottle body enables the sealing ring to be embedded into the wedge-shaped opening by uplifting push pedal, achieving a perfect sealing effect between cover body and cup body or bottle body, and cover is firmly attached to the mouth edge of cup body or bottle body due to static friction force increased, without screw connection needed, thus the mouth edge may be in any form in addition to circle, enriching models of cup or bottle.

DETAILED DESCRIPTION

Figure 1:
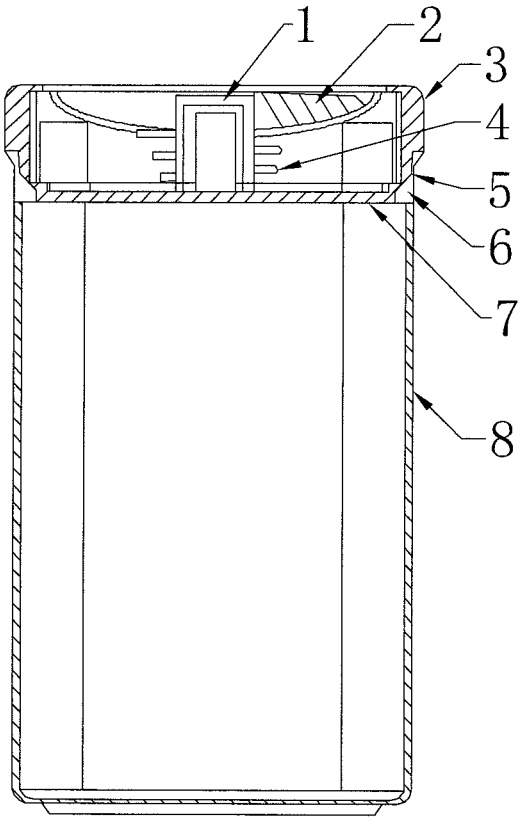
FIG. 1 Sectional view of this utility model
FIG. 2 Exploded view of this utility model
FIG. 3 Structure diagram of handle and lifting element
Figure 2:
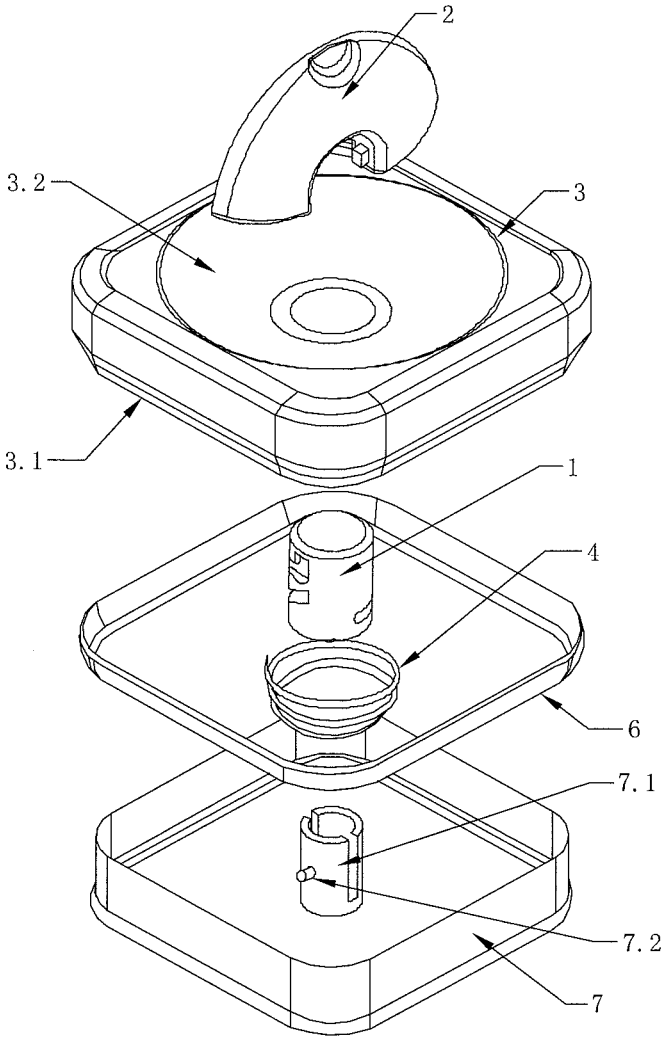

As shown in FIG. 1 & FIG. 2, this utility model is a quickly-sealing cover comprising the cover body 3 matched with cup body or bottle body 8, the mouth edge of the cup body or bottle body 8 may be polygon or irregular shape. The lower end of cover body 3 is partially embedded into cup body or bottle body 8, the outer wall at the lower end of cover body 3 is equipped with an inward-retracted bevel edge 3.1, forming a wedge-shaped opening 5 that surrounds the lower end of cover body 3 between the lower end of cover body 3 and cup body or bottle body 8. Below the cover body 3 flexibly installs a push pedal 7, on which sealing ring 6 is equipped, the upper edge of sealing ring 6 is opposite to the wedge-shaped opening 5; and the upper edge of sealing ring 6 is embedded into the wedge-shaped opening 5 when the push pedal 7 moves upward. Seal ring 6 embedded into the wedge-shaped opening 5 helps fill the gap between the gap between the cover body 3 and cup body or bottle body 8, achieving a perfect sealing effect. During sealing, seal ring 6 is squeezed, without slight rubber mass produced; the push pedal 7 that is partially embedded into the bottom part of cover body 3 does not waggle or rotate the push pedal 7.

The push pedal (7) is equipped with an upward extended shaft (7.1), a lifting element (1) that is equipped within the cover body (3) is set to the shaft (7.1), on which a guide block (7.2) that is flexibly embedded into a spiral guide groove (1.3) that is placed on the outer wall of the lifting element (1) is equipped; when the lifting element (1) rotates, the guide block (7.2) may move in the spiral guide groove (1.3), driving the push pedal (7) to move upward and downward. Two centrally-symmetric spiral grooves 1.3 are provided on the lifting element 1, and two guide blocks 7.2 are accordingly equipped on the shaft 7.1, enabling smooth lift of the push pedal 7. The fore shaft 1.4 is provided at upper end of the spiral guide groove 1.3, and when the push pedal 7 is lifted to an appropriate height, the guide block 7.2 is embedded into the fore shaft 1.4, locking the push pedal 7. The bearing spring 4 placed between push pedal 7 and cover body 3 can prevent the guide block 7.2 from slipping off from the fore shaft 1.4.

The handle 2 installed on the upper end of the lifting element 1 is capable of rotating the lifting element 1 when turning it. The handle 2 that is hinged with the lifting element 1 is capable of being folded and embedded into a groove 3.2 that is provided on the cover body 3. When kept idle, the handle 2 may be hidden to avoid collision with any external force.

Figure 3:
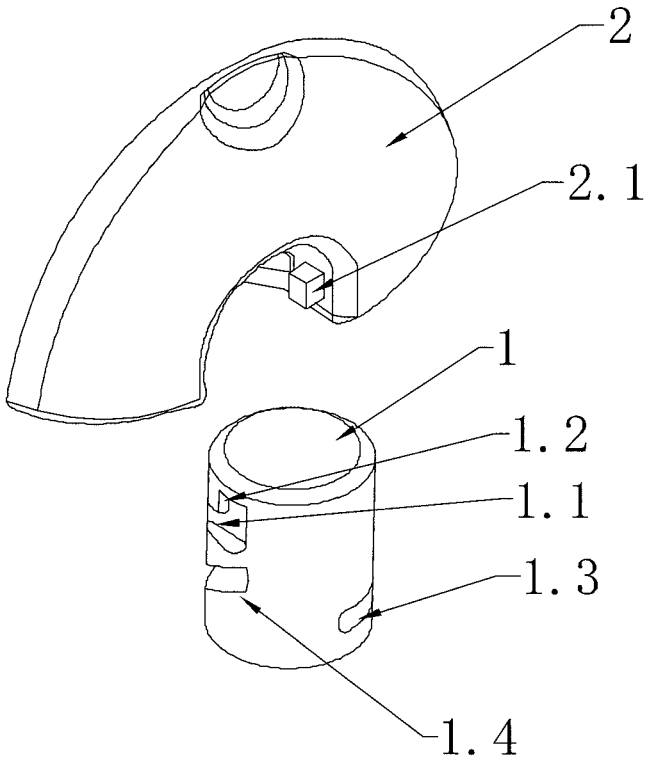

As shown in FIG. 3, a square-shaped locked groove 1.2 is provided on the upper part of the installing groove 1.1 that is provided at both sides of the lifting element 1, an installing block 2.1 that is capable of being embedded into the square-shaped locked groove 1.2 is provided on the handle 2, and the top surface and both sides of the installing block 2.1 are planes, making the handle 2 locked at the vertical-open status and the horizontal-folded status. The restoring force of the spring 4 between cover body 3 and push pedal 7 is capable of locking the installing block 2.1 that is placed on the handle 2 into the square-shaped locked groove 1.2. Place cover on a plane and the push pedal 7 at low part, press cover body 3 this moment, the handle 2 may be taken out. This utility model installed on cup body or bottle body 8 enables the sealing ring 6 to be embedded into the wedge-shaped opening 5 by uplifting push pedal 7, achieving a perfect sealing effect between cover body 3 and cup body or bottle body 8, and cover body 3 is firmly attached to the mouth edge of cup body or bottle body 8 due to static friction force increased, without screw connection needed, thus the mouth edge of cup body or bottle body 8 may be in any form in addition to circle, enriching models of cup or bottle.

The invention claimed is:

1. A quickly-sealing cover comprising a cover body matched with a cup body or bottle body, with a lower end of the cover body partially embedded into the cup body or bottle body, wherein the outer wall at the lower end of the cover body is equipped with an inward-retracted bevel edge, forming a wedge-shaped opening that surrounds the lower end of the cover body between the lower end of the cover body and the cup body or bottle body, below the cover body flexibly installs a push pedal, on which a sealing ring is equipped, an upper edge of the sealing ring is opposite to the wedge-shaped opening; and the upper edge of the sealing ring is embedded into the wedge-shaped opening when the push pedal moves upward.

2. The quickly-sealing cover described in claim 1, wherein the push pedal is partially inserted into a bottom part of the cover body.

3. The quickly-sealing cover described in claim 1, wherein the push pedal is equipped with an upward extended shaft, a lifting element that is equipped within the cover body is set to the shaft, on which a guide block that is flexibly embedded into a spiral guide groove that is placed on the outer wall of the lifting element is equipped; when the lifting element rotates, the guide block may move in the spiral guide groove, driving the push pedal to move upward and downward.

4. The quickly-sealing cover described in claim 3 further comprising a fore shaft equipped on an upper end of the spiral guide groove.

5. The quickly-sealing cover described in claim 3, further comprising a bearing spring between the push pedal and the cover body.

6. The quickly-sealing cover described in claim 3, further comprising two centrally symmetric spiral guide grooves provided on the lifting element, and two guide blocks accordingly provided on the shaft.

7. The quickly-sealing cover described in claim 3, further comprising a handle installed on an upper end of the lifting element, which is capable of rotating the lifting element when turning it.

8. The quickly-sealing cover described in claim 7, wherein the handle that is hinged with the lifting element is capable of being folded and embedded into a groove that is provided on the cover body.

9. The quickly-sealing cover described in claim 8, further comprising a square-shaped locked groove on the upper part of the installing groove that is provided at both sides of the lifting element, an installing block that is capable of being embedded into the square-shaped locked groove is provided on the handle, and a top surface and both sides of the installing block are planes, so that the handle is locked.

* * * * *